US005244180A

United States Patent [19]

Wakeman et al.

[11] Patent Number: 5,244,180

[45] Date of Patent: Sep. 14, 1993

[54] SOLENOID PRE-LOADER

[75] Inventors: Russell J. Wakeman; John S. Bright; Kenric J. Johnson, all of Newport News, Va.

[73] Assignee: Siemens Automotive L.P., Auburn Hills, Mich.

[21] Appl. No.: 939,803

[22] Filed: Sep. 3, 1992

[51] Int. Cl.[5] ..... F16K 31/06

[52] U.S. Cl. ..... 251/129.16; 251/129.15; 239/585.5

[58] Field of Search ..... 251/129.16, 129.21, 251/129.22, 129.15; 239/585.1, 585.5

[56] References Cited

U.S. PATENT DOCUMENTS

| | | | |
|---|---|---|---|
| 1,892,917 | 1/1933 | Walker et al. | 251/129.22 |
| 4,572,436 | 2/1986 | Stettner et al. | 251/129.16 X |
| 4,696,379 | 9/1987 | Yamamoto et al. | 251/129.21 X |
| 5,005,803 | 4/1991 | Fritz et al. | 251/129.21 X |

*Primary Examiner*—Arnold Rosenthal

*Attorney, Agent, or Firm*—George L. Boller; Russel C. Wells

[57] ABSTRACT

The solenoid portion of a solenoid-operated valve is resiliently biased by a pre-loader against an internal shoulder on the valve body to maintain precision of the stator-armature working gap during the useful life of the valve. Several embodiments of pre-loader are disclosed, including a Belleville spring, a wave spring, and an elastomeric ring.

5 Claims, 2 Drawing Sheets

SOLENOID PRE-LOADER

FIELD OF THE INVENTION

This invention relates generally to solenoid-operated fluid valves. More specifically, it relates to an improvement for maintaining precision of the stator-armature working gap during the useful life of a solenoid-operated valve.

BACKGROUND AND SUMMARY OF THE INVENTION

Certain solenoid-operated valves, such as fuel injectors, are typically assembled using traditional devices, such as threaded fasteners, crimps, and stakes. These joining techniques are subject to relaxation, spring-back, and lash which, over the useful life of a valve, may give rise to degradation in the valve's performance.

Accordingly, it is an object of the present invention to provide an improvement that avoids such degradation. Generally speaking, the present invention comprises the inclusion of a solenoid pre-loader that is arranged to keep the stator's solenoid disposed against an internal shoulder on the valve body. In the preferred embodiment of the invention, this shoulder is an annular lift spacer that sits on an integral internal shoulder of the valve body and has a thickness that calibrates the valve lift to a predetermined specification. Various forms of pre-loaders are contemplated and will be hereinafter described.

Drawings accompany the disclosure and depict a presently preferred embodiment of the invention according to the best mode contemplated at this time for carrying out the invention.

DESCRIPTION OF THE PREFERRED EMBODIMENT

Figure 1:
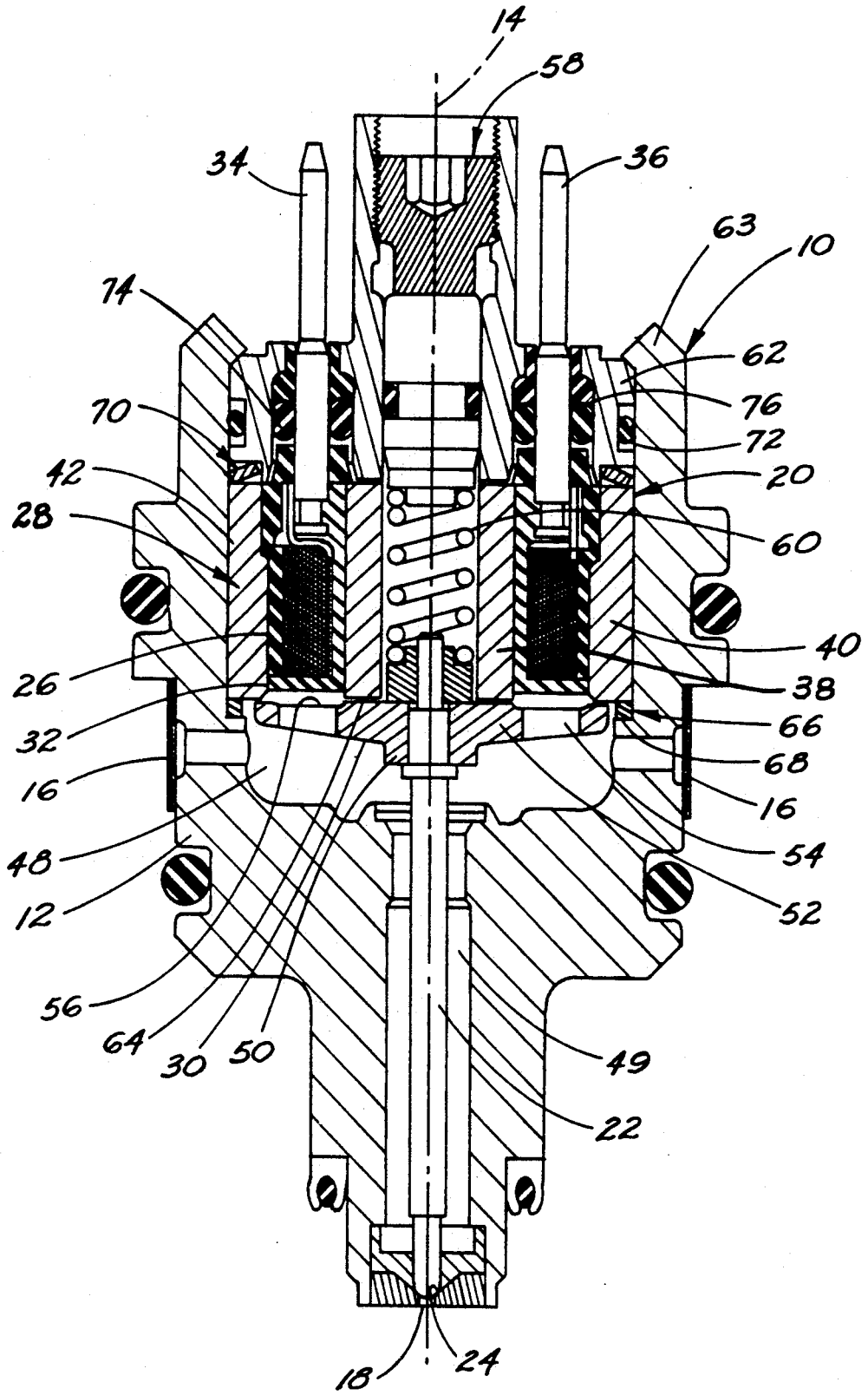
FIG. 1 is a longitudinal cross sectional view through an exemplary solenoid-operated valve embodying principles of the invention.
Figure 2:
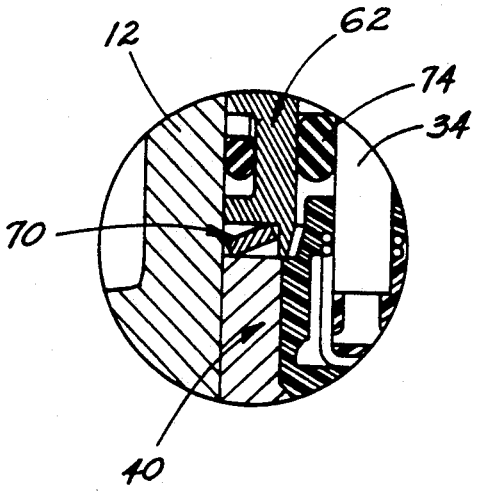
FIG. 2 is an enlarged fragmentary view of a portion of FIG. 1.

FIGS. 1 and 2 show an electromechanical fuel injector 10 comprising a generally cylindrical body 12 having a longitudinal axis 14. Fuel injector 10 is a side-feed type having a fuel inlet 16 in the sidewall of body 12 so that pressurized fuel enters the fuel injector through its sidewall when the fuel injector is installed in a sealed manner in an injector-receiving socket (not shown) of an engine-mounted component such as a manifold, fuel rail, or cylinder head. A nozzle 18 from which fuel is injected is disposed at the lower end of body 12. On the interior of body 12, fuel injector 10 comprises a solenoid 20 that operates a needle valve 22 for selective seating on and unseating from a valve seat 24 at the nozzle end. FIG. 1 shows needle valve 22 seated on valve seat 24 thereby closing the fuel injector to flow between inlet 16 and nozzle 18.

Solenoid 20 comprises an electromagnetic coil 26, a stator 28 and an armature 30. Coil 26 is a length of insulated wire wound into a tubular configuration on a bobbin 32 coaxially disposed within body 12. Respective ends of the wire are joined to proximal ends of respective electrical terminals 34, 36 that are embedded in bobbin 32 and extend away from the bobbin parallel with axis 14.

Stator 28 is ferromagnetic and comprises an inner circular cylindrical tube 38 that is disposed interiorly of and coaxial with bobbin 32, an outer circular cylindrical tube 40 that is disposed exteriorly of and coaxial with bobbin 32, and an upper end wall 42 that joins the upper ends of tubes 38 and 40. End wall 42 overlies the top of coil 26 and an upper flange of bobbin 32, having holes shaped to allow those portions of bobbin 32 within which terminals 34, 36 are embedded to pass through. The lower ends of tubes 38 and 40 are co-planar, lying perpendicular to axis 14.

Armature 30 is disposed within an interior space 48 of body 12 into which fluid is introduced via inlet 16. A passageway 49 extends co-axially from space 48 to valve seat 24. Armature 30 has a center hub 50 to which the upper end of needle valve 22 is affixed and around the upper axial end of which a circular flange 52 is disposed. Flange 52 may include several holes 54. Armature 30 presents a flat upper end face 56 to the co-planar lower ends of tubes 38 and 40.

Upper end face 56 fully radially overlaps tube 38 and partially radially overlaps tube 40. An adjustment mechanism 58 is disposed coaxially on fuel injector 10, compressing a helical coil spring 60 that acts on armature 30. The mounting of adjustment mechanism 58 on fuel injector 10 is by means of a member 62 that inserted into body 12 and held in place by a crimp 63. Member 62 contains holes that allow for terminals 34, 36 to pass through.

When solenoid 20 is not energized, spring 60 forces armature 30 downwardly, causing needle valve 22 to seat on valve seat 24, thereby closing the flow path through the fuel injector between inlet 16 and nozzle 18.

A working gap 64 exists between armature 30 and stator 28, and in the de-energized condition of solenoid 20 it has a maximum axial dimension. When the solenoid is energized to unseat needle 22 from seat 24 and thereby open the flow path through the fuel injector, magnetic flux is created in stator 28, armature 30, and working gap 64, attracting the armature toward the stator so as to reduce the axial extent of the working gap. The lower ends of stator tubes 38 and 40 will be abutted by the upward displacement of the armature. In this way working gap 64 will be reduced in response to solenoid energization.

Working gap 64 comprises radially inner and radially outer annular zones. The radially inner annular zone of the working gap is bounded axially by the lower end face of tube 38 and by an underlying annular zone of armature 30. The radially outer annular zone of working gap 64 is bounded axially by the lower end face of the radially outer tube 40 and by an underlying annular zone of armature 30. Magnetic flux passes in one direction through the radially outer annular zone of the working gap, and in the opposite direction through the radially inner annular zone of the working gap.

To assure desired fuel injector response to solenoid operation, it is important that the axial dimension of working gap 64 be precisely set and then maintained. The lift of needle valve 22, i.e. the axial dimension of the working gap, is calibrated by the thickness of an annular lift spacer 66 that is seated on an internal shoulder 68 of body 12. Stator 28, coil 30 and bobbin 32 form a unitary assembly which is axially located within body 12 by abutting the outer margin of the lower end of outer tube 40 against lift spacer 66. By maintaining such abutment, the axial dimension of the working gap will also be maintained. The abutment is maintained despite factors mentioned earlier, i.e. relaxation, spring-back, and lash variations, by providing a resiliently expansible means between body 12 and the solenoid that continually urges the stator against lift spacer 66, and in turn against the underlying shoulder 68. FIGS. 1 and 2 illustrate a constant force Belleville spring 70 as a first example of such a resiliently expansible means. Spring 70 is disposed axially between member 62 and the upper end of tube 40. The lower end of member 62 contains a groove to accommodate the spring.

It should also be observed in the fuel injector of FIG. 1 that coil 26, stator 28, armature 30, bobbin 32, and spring 70 are exposed to the fluid flowing through the fuel injector. Sealing of the upper axial end of the interior of the fuel injector against external leakage is provided by an 0-ring seal 72 between member 62 and body 12, and there are 0-ring seals 74, 76 between terminals 34, 36 and member 62. An electrical connector plug (not shown) is mated with terminals 34, 36 to establish electrical connection of the solenoid coil to a control circuit for operating the fuel injector.

Figure 3:
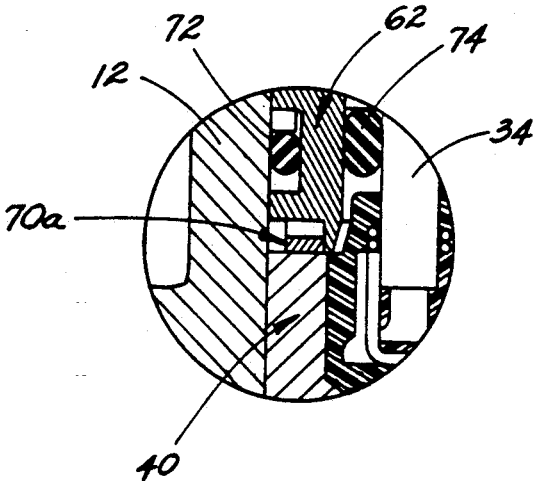
FIG. 3 is a view similar to FIG. 2 illustrating a modified form.

FIG. 3 illustrates a modified form of resiliently expansible means comprising a wave spring 70*a* instead of a Belleville spring. Both types of spring are of course metal.

Figure 4:
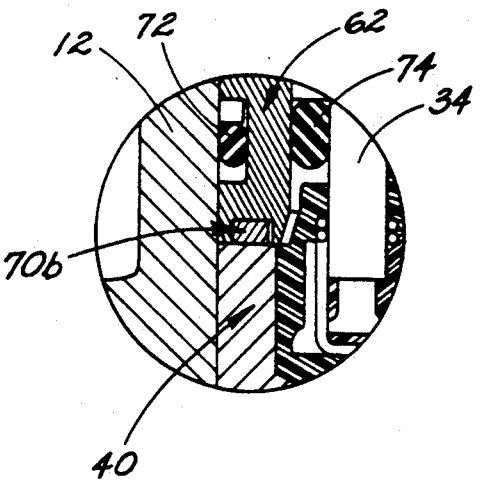
FIG. 4 is a view similar to FIG. 2 illustrating another modified form.

FIG. 4 illustrates another modified form of resiliently expansible means comprising an elastomeric annulus 70*b*. While this particular form may provide sealing, the use of O-ring seal 72 is retained. The elastomeric annulus 70*b* is disposed in a three-sided groove in member 62.

Figure 5:
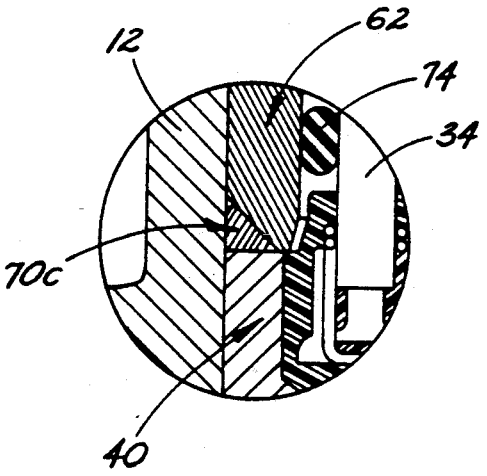
FIG. 5 is a view similar to FIG. 2 illustrating still another modified form.

FIG. 5 illustrates still another modified form of resiliently expansible means comprising an elastomeric annulus 70*c*. While this particular form may provide sealing, the use of O-ring seal 72 is retained. The elastomeric annulus 70*b* has a three-sided shape in cross section for disposition against the inside wall of body 12, against tube 40, and against a bevel of member 62.

While a presently preferred embodiment of the invention has been illustrated and described, it should be appreciated that principles are applicable to other embodiments. For example, the resiliently expansible means can be implemented by diaphragms or beams machined directly into one of the stacked parts, and placed in any location where the requisite force can be imparted to urge the solenoid portion against the fixed internal shoulder within the valve body.

What is claimed is:

1. A solenoid-operated fluid valve comprising a body having a longitudinal axis and a valve portion that controls fluid flow through the valve and that is operatively coupled with a solenoid mounted on said body, said solenoid comprising an electromagnetic coil and an associated magnetic circuit for conducting magnetic flux issued by said coil, said coil and magnetic circuit being disposed within an axially extending bore of said body, said magnetic circuit comprising a stator, an armature, and a working gap that is disposed between said stator and said armature, said armature being operated by said coil to control fluid flow through said valve portion, bore closure means closing an open end of said bore in a sealed manner such that said coil and magnetic circuit are within an internal zone that is exposed to fluid passing through the valve, said solenoid comprising terminal means passing through said bore closure means in a sealed manner to provide for electric current to flow through said coil from an external current source, characterized in that a resiliently axially expansible annulus is disposed in said zone within and extending circumferentially around said bore to act axially between said bore closure means and said solenoid for keeping said stator forced axially against said shoulder, and in that said resiliently expansible annulus lies radially outwardly of said terminal means.

2. A solenoid-operated fluid valve as set forth in claim 1 characterized further in that said shoulder is provided by a ring that is supported on an integral internal shoulder of said body.

3. A solenoid-operated fluid valve as set forth in claim 1 characterized further in that said resiliently expansible annulus comprises a Belleville washer that is disposed to act between said bore closure means and said stator.

4. A solenoid-operated fluid valve as set forth in claim 1 characterized further in that said resiliently expansible annulus comprises a wave washer that is disposed to act between said bore closure means and said stator.

5. A solenoid-operated fluid valve as set forth in claim 1 characterized further in that said resiliently expansible annulus comprises an elastomeric ring that is disposed to act between said bore closure means and said stator.

* * * * *